US008881429B2

(12) United States Patent
Schwartz

(10) Patent No.: US 8,881,429 B2
(45) Date of Patent: Nov. 11, 2014

(54) ASYMMETRICAL FOOTWEAR HAVING A CONFIGURATION THAT IS CONTINUOUS FROM ONE SHOE TO ANOTHER

(76) Inventor: Mor Koren Schwartz, New York, NY (US)

( * ) Notice: Subject to any disclaimer, the term of this patent is extended or adjusted under 35 U.S.C. 154(b) by 363 days.

(21) Appl. No.: 12/773,635

(22) Filed: May 4, 2010

(65) Prior Publication Data

US 2011/0247242 A1 Oct. 13, 2011

Related U.S. Application Data

(63) Continuation-in-part of application No. 12/759,546, filed on Apr. 13, 2010, now abandoned.

(51) Int. Cl.

| | |
|---|---|
| ***A43B 5/00*** | (2006.01) |
| ***A43B 3/00*** | (2006.01) |
| ***A43B 23/00*** | (2006.01) |
| ***A43B 3/12*** | (2006.01) |

(52) U.S. Cl.

CPC ..... *A43B 3/0047* (2013.01); *A43B 3/0036* (2013.01)

USPC ..... 36/35 R; 36/1.5; 36/136; 36/11.5

(58) Field of Classification Search

CPC ..... A34B 23/24–23/26; A34B 13/145

USPC ..... 36/100, 101, 112, 11.5, 45, 50.1; D2/916, 917, 897

See application file for complete search history.

(56) References Cited

U.S. PATENT DOCUMENTS

| | | | | |
|---|---|---|---|---|
| 3,906,642 A | | 9/1975 | Cohen | |
| D238,017 S | | 12/1975 | Cohen | |
| D238,216 S | | 12/1975 | Cohen | |
| D240,170 S | | 6/1976 | Cohen | |
| 4,267,649 A | * | 5/1981 | Smith | 36/101 |
| 4,450,633 A | | 5/1984 | Connelly | |

(Continued)

FOREIGN PATENT DOCUMENTS

| | | | | |
|---|---|---|---|---|
| JP | 10-052302 A | | 2/1998 | |
| JP | 10052302 A | * | 2/1998 | A43B 23/24 |
| JP | 10-155513 A | | 6/1998 | |

OTHER PUBLICATIONS

The above references were cited in a International Search Report issued on Feb. 8, 2012, that issued in the corresponding International Application No. PCT/US2011/031673.

(Continued)

*Primary Examiner* — Khoa Huynh

*Assistant Examiner* — Timothy K Trieu

(74) *Attorney, Agent, or Firm* — Cowan, Liebowitz & Latman, P.C.

(57) ABSTRACT

An asymmetrical footwear assembly comprising a first article of footwear and a second article of footwear, said first and second articles of footwear being adapted to be worn on a user's right and left feet, respectively, wherein a configuration of the first article of footwear is asymmetrical with respect to a configuration of said second article of footwear so that the first and second articles of footwear are not mirror images of one another, and wherein, when the first and second articles of footwear are adjacent to one another, the configurations of the first article of footwear and of the second article of footwear create a visual effect of continuity between the configurations of the first and second articles of footwear and form a predetermined design.

3 Claims, 12 Drawing Sheets

(56) References Cited

U.S. PATENT DOCUMENTS

| | | | | |
|---|---|---|---|---|
| 4,471,539 | A * | 9/1984 | Mann | 36/11.5 |
| D296,607 | S | 7/1988 | Iber | |
| D366,752 | S | 2/1996 | Sherman | |
| D426,942 | S | 6/2000 | Doubleday | |
| 6,430,847 | B2 | 8/2002 | Fusco et al. | |
| D540,531 | S | 4/2007 | Lee | |
| 7,347,010 | B2 | 3/2008 | Yu | |
| 2002/0020082 | A1 | 2/2002 | James | |
| 2002/0029494 | A1 * | 3/2002 | Small | 36/54 |
| 2005/0039345 | A1 * | 2/2005 | Jones et al. | 36/11.5 |
| 2005/0223600 | A1 | 10/2005 | Hunter et al. | |
| 2006/0032085 | A1 * | 2/2006 | Randall | 36/8.3 |
| 2006/0090375 | A1 | 5/2006 | Chen | |
| 2007/0137067 | A1 | 6/2007 | Fallon et al. | |
| 2007/0240335 | A1 | 10/2007 | Fitzgerald | |
| 2007/0245598 | A1 * | 10/2007 | Pawsey | 36/136 |
| 2008/0229615 | A1 | 9/2008 | Yu | |
| 2009/0038181 | A1 * | 2/2009 | Loughnane | 36/94 |
| 2010/0083533 | A1 * | 4/2010 | Terner et al. | 36/43 |

OTHER PUBLICATIONS

Camper Online Shop-Women Shoes (2010), Camper 2010 TWS Shoe Line, pp. 1-3. Retrieved Apr. 14, 2010, from http://shop.camper.com.

Men's Shoes Manufactured by Makeup Company, pp. 1-3.

Camper News TWS Miró, Apr. 15, 2009, pp. 1-5. Retrieved Apr. 14, 2010, from http://news.camper.com/camper-shoes/product/tws-miro/.

* cited by examiner

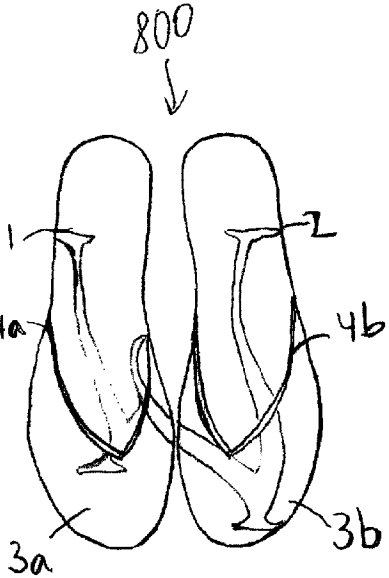
FIG. 8A
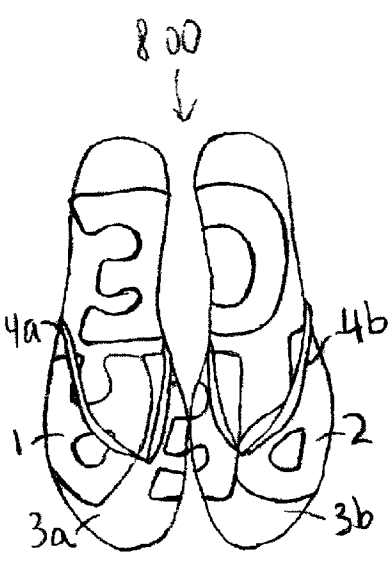
FIG. 8B
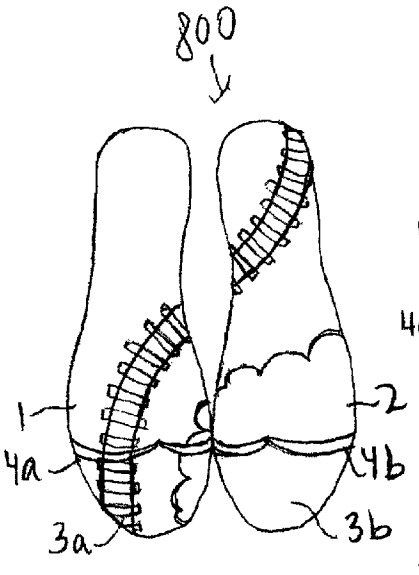
FIG. 8C
FIG. 8D

ASYMMETRICAL FOOTWEAR HAVING A CONFIGURATION THAT IS CONTINUOUS FROM ONE SHOE TO ANOTHER

CROSS-REFERENCE TO RELATED APPLICATIONS

This application is a continuation-in-part of application Ser. No. 12/759,546, filed on Apr. 13, 2010, now abandoned the entire disclosure of which is hereby incorporated by reference.

FIELD OF THE INVENTION

This invention relates to asymmetrical footwear, and in particular to an asymmetrical footwear assembly including a pair of articles of footwear having asymmetrical configurations with respect to one another, with the configuration of one article of footwear in the pair being continuous with the configuration of the other article of footwear so as to create a visual effect of continuity and to form a unified and common theme.

BACKGROUND OF THE INVENTION

Footwear design and construction are extremely important to their wearers as well as to footwear manufacturers. Footwear not only provides comfort and support to the wearer's feet, but also defines the wearer's style and image. Clothing and footwear companies are constantly developing new styles and trends of footwear as well as new materials and construction features in order to distinguish themselves from others and to provide new options to consumers. Consumers often look for the latest and unique styles of footwear in order to achieve a unique image and to define their style.

Symmetrical footwear is well known in the art and is widely sold in commerce. Footwear is sold in pairs, having a left shoe and a right shoe, and the shoes in the pair are typically mirror images of one another. That is, in all styles and categories of shoes, including men's, women's and children's shoes, the configuration of the right shoe is usually identical to the configuration of the left shoe, and the right and left shoes are symmetrical so that the right and left shoes are mirror images of one another. There are numerous different styles and trends of symmetrical footwear, which range from elegant to casual to athletic styles, from high heels to flats and from platforms to wedges.

In addition, there are also shoes in the market which are not symmetrical, with the left shoe and the right shoe having different physical configurations. However, such asymmetrical shoes typically include two similar shoes which have individual adjustments for each foot for a particular purpose. For example, U.S. Pat. No. 6,430,847 discloses asymmetric shoes for use in sports, such as fencing, so as to accommodate for asymmetric movement of the wearer's feet. In the '847 patent, each shoe in a pair has a configuration which is adapted for a particular use, so that the thickness and cushioning of the sole of a trailing shoe is different from the leading shoe, the leading shoe includes a heel cup, a protective toe patch and an overlay which are not included in the trailing shoe, and the trailing shoe includes a high abrasion insert which is not included in the leading shoe. In the '847 patent, there is no connection or continuity between the different configurations of the trailing and leading shoes, and each shoe is independently adapted for a particular use or function, without regard to overall appearance of the shoes.

There is a need for a new configuration of footwear which can be modified in a variety of ways so as to create new styles, trends and designs. There is also a need for a new configuration of footwear which can be used with many different types of shoes.

It is, therefore, an object of the present invention to provide a new configuration of asymmetrical footwear that can be used and modified in many different ways to develop new styles, trends and designs and to expand the possibilities of new footwear designs. It is also an object of the present invention to provide a new configuration of asymmetrical footwear that can be used with all footwear categories, including men's, women's and kids' footwear, and with all different styles of footwear, including, but not limited to, boots, shoes, sandals, pumps, clogs, mules, oxfords, loafers, slippers, wedges, platforms, espadrilles, booties, mary janes, t-straps, slides, thongs, flip flops, flats, slingbacks, ballerina shoes, specialty shoes such as wide shoes, narrow shoes, dance shoes, diabetic approved shoes, eco-friendly shoes, bridal shoes, vegetarian/vegan shoes, etc.

SUMMARY OF THE INVENTION

An asymmetrical footwear assembly comprising a first article of footwear and a second article of footwear, said first and second articles of footwear being adapted to be worn on a user's right and left feet, respectively, wherein a configuration of the first article of footwear is asymmetrical with respect to a configuration of said second article of footwear so that the first and second articles of footwear are not mirror images of one another, and wherein, when the first and second articles of footwear are adjacent to one another, the configurations of the first article of footwear and of the second article of footwear create a visual effect of continuity between the configurations of the first and second articles of footwear and form a predetermined design. The first article of footwear in the asymmetrical assembly comprises a first sole and a first upper portion coupled to the first sole and the second article of footwear comprises a second sole and a second upper portion coupled to the second sole, wherein the configuration of the first upper portion is asymmetrical with respect to the configuration of the second upper portion, and when the first and second articles of footwear are adjacent to one another, the configurations of the first and second upper portions create a visual effect of continuity therebetween and form the predetermined design.

In certain embodiments, the asymmetrical configurations of the first and second upper portions are the shapes thereof, so that when the first and second articles of footwear are adjacent to one another, the shapes of the first and second upper portions create a visual effect of continuity therebetween. In some embodiments, the configuration of the first upper portion includes one or more strap members and the configuration of the second upper portion includes one or more strap members, wherein the configurations of the first and second upper portions create a visual effect of continuity between at least one strap member of the first upper portion and at least one strap member of the second upper portion. In certain embodiments, the configurations of the first and second upper portions include one or more fastening members, wherein the configurations of the first and second upper portions create a visual effect of continuity between at least one fastening member of the first upper portion and at least one fastening member of the second upper portion when the first and second articles of footwear are adjacent to one another.

The fastening members include one or more of a zipper, a lacing system, a lace, a strap with a buckle, a hook, a plurality of hooks and VELCRO®.

In some embodiments, the first upper portion is formed from a plurality of first pieces coupled with one another and the second upper portion is formed from a plurality of second pieces coupled with one another, wherein, when the first and second articles of footwear are adjacent to one another, the arrangements of the first and second plurality of pieces create a visual effect of continuity between at least one of the first plurality of pieces and at least one of the second plurality of pieces. The first plurality of pieces may include at least two pieces of contrasting colors and the second plurality of pieces may include at least two pieces of contrasting colors, so that when the first and second articles of footwear are adjacent to one another, the first and second plurality of pieces create a visual effect of continuity between like colors of the first plurality of pieces and the second plurality of pieces.

In some embodiments, the first upper portion includes a motif or a first portion of a motif applied thereto and the second portion includes the same motif or a second portion of the motif applied thereto, wherein, when the first and second articles of footwear are adjacent to one another, the first and second upper portions create a visual effect of the motif being continuous from the first upper portion to the second upper portion. Such motifs may be formed by stitching, dyeing of the upper portions or any other suitable means.

In some embodiments of the asymmetrical footwear assembly, the first article of footwear comprises a first sole and a first upper portion coupled to first sole, the second article of footwear comprises a second sole and a second upper portion coupled to the second sole, the configuration of the first sole is asymmetrical with respect to the configuration of the second sole, and when the first and second articles of footwear are adjacent to one another, the configurations of the first and second soles create the visual effect of continuity between the configuration and form the predetermined design.

The asymmetrical footwear of the present invention can be one or more of a pair of shoes, a pair of boots, a pair of sandals and a pair of athletic footwear. Any style of footwear may be used in the present invention.

BRIEF DESCRIPTION OF THE DRAWINGS

The following description, given by way of example and not intended to limit the present invention solely thereto, will be best appreciated in conjunction with the accompanying drawings, wherein like reference numerals denote like elements and parts, in which:

FIGS. 8A-8D show top views of illustrative embodiments of sandal footwear assemblies of the present invention.

DETAILED DESCRIPTION OF THE INVENTION

The present invention is directed to an asymmetrical footwear assembly that includes a pair of articles of footwear for wearing by a user on right and left feet. The asymmetrical footwear configuration of the present invention can be used with men's footwear, women's footwear, children's footwear of any style, including elegant footwear, casual footwear, career footwear, athletic footwear and the like, and more specifically, including but not limited to boots, shoes, sandals, pumps, clogs, mules, oxfords, loafers, slippers, wedges, platforms, espadrilles, booties, mary janes, t-straps, slides, thongs, flip flops, flats, slingbacks, ballerina shoes, specialty shoes such as wide shoes, narrow shoes, dance shoes, diabetic approved shoes, eco-friendly shoes, bridal shoes, vegetarian/vegan shoes, etc. As described below and as shown in FIGS. 1A-9B, the asymmetrical footwear assembly of the present invention includes a pair of shoes, or a pair of articles of footwear, wherein one shoe has a different configuration from the other shoe and is not symmetrical with the other shoe, and wherein the configuration of one shoe is continuous with the configuration of the other shoe so that, when the pair is worn by the user and/or the two shoes in the pair are adjacent to one another, a visual effect of continuity is created between the two shoes and a unified theme, shape or design is formed by the two shoes.

Figures 5A, 5B, 5C:
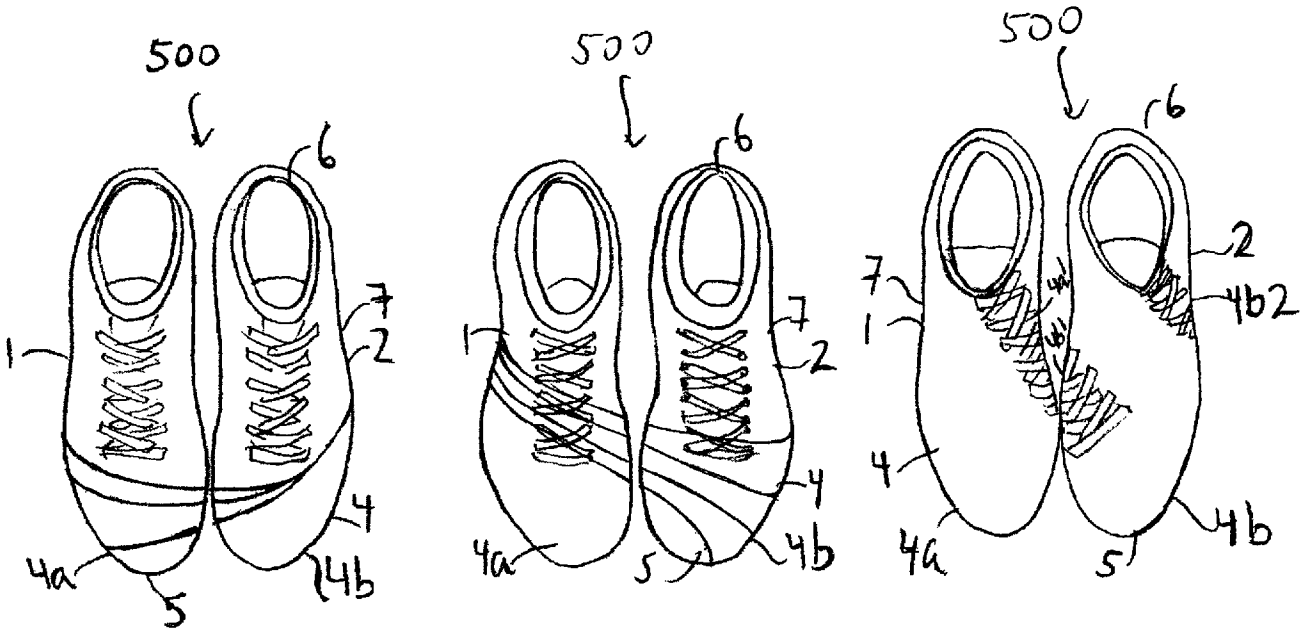
FIGS. 5A-5C are top views of illustrative embodiments of athletic footwear assemblies of the present invention.
Figure 6A:
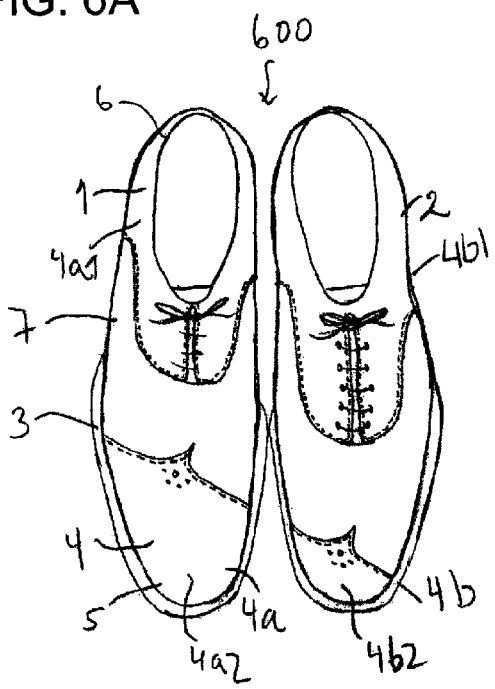
FIGS. 6A-6D are top views of illustrative embodiments of men's footwear assemblies of the present invention.
Figure 6B:
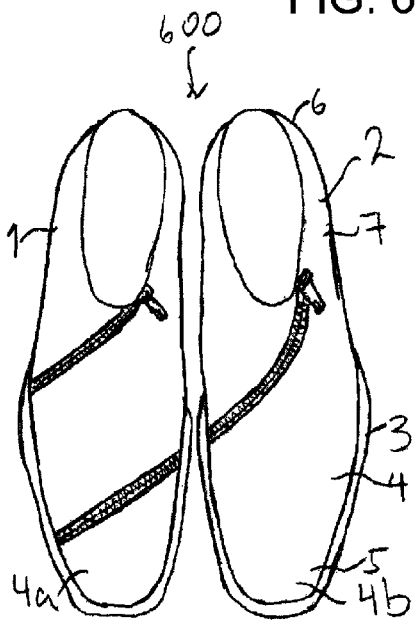
Figure 6C:
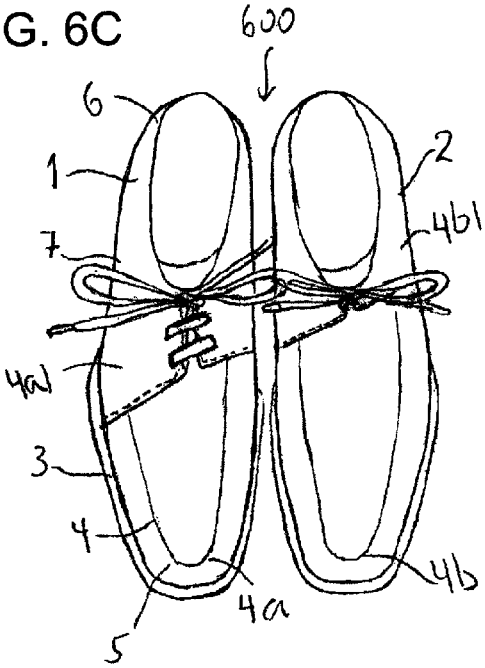
Figure 6D:
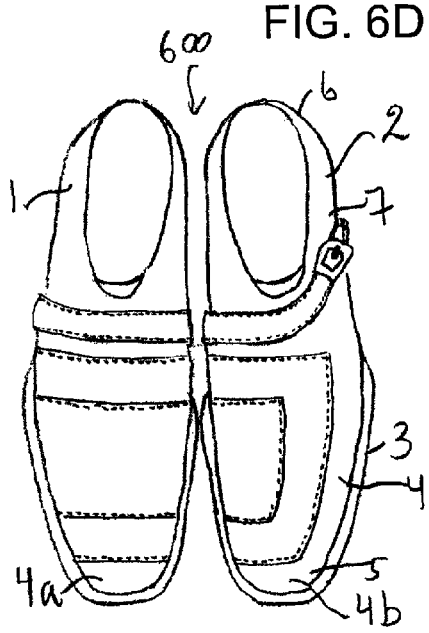
Figure 7A:
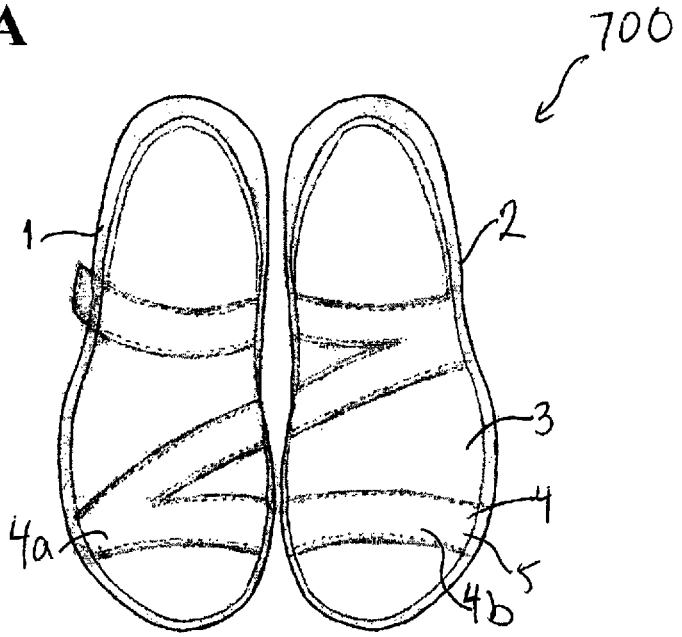
FIGS. 7A-7C are top views of illustrative embodiments of children's footwear assemblies of the present invention.
Figure 7B:
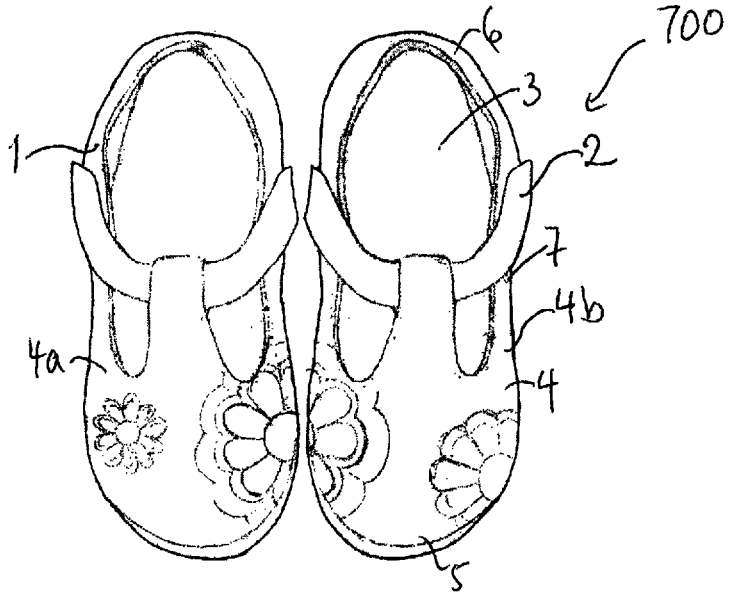
Figure 7C:
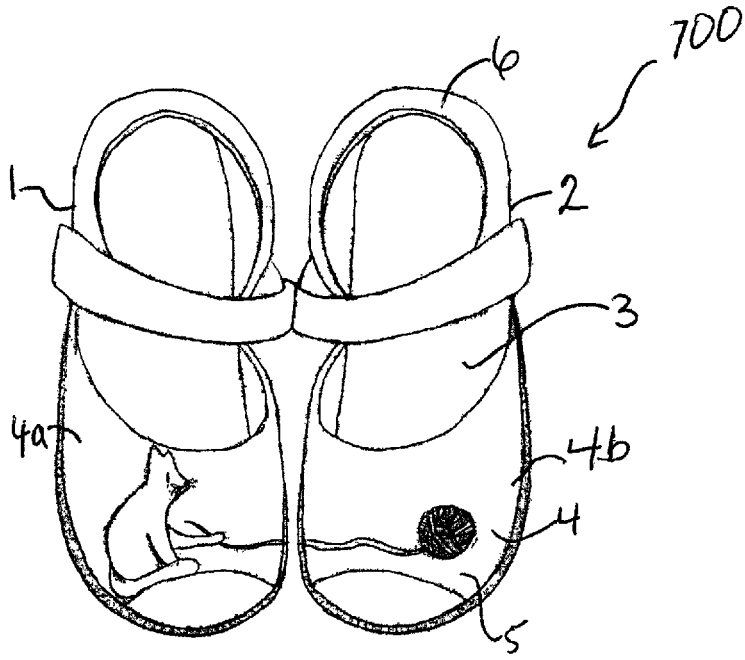

FIGS. 1A-9B show various illustrative embodiments of an asymmetrical footwear assembly of the present invention, which include women's asymmetrical shoes (FIGS. 1A-1F and 9A-9B), women's asymmetrical sandals (FIGS. 2A-2B and 8A-8D), women's asymmetrical boots (FIGS. 3A-4B), athletic asymmetrical footwear (FIGS. 5A-5C), men's asymmetrical footwear (FIGS. 6A-6D) and children's asymmetrical footwear (FIGS. 7A-7C). As shown in FIGS. 1A-9B, the asymmetrical footwear assembly 100 comprises a pair of shoes, or a pair of articles of footwear, including a first shoe 1 and a second shoe 2, adapted to be worn together by the user on the user's right foot and left foot. Each shoe, or article of footwear, comprises a sole 3 and an upper portion 4. The sole can be formed from any suitable material for supporting the user's foot and, in some embodiments includes a heel, while in other embodiments may be formed as a substantially flat member.

In the embodiments shown in FIGS. 1A-7C, the soles 3 of the shoes or articles of footwear in each pair are substantially symmetrical, forming mirror images of one another. However, in other embodiments, such as the ones shown in FIGS. 8A-8D and 9A-9B, the soles of the shoes, or articles of footwear, in a pair are asymmetrical, and also have configurations which create a visual effect of continuity between the two soles, when the shoes are adjacent to one another, so as to form a singular unified design. For example, in the embodiments of FIGS. 9A and 9B, the heels of the shoes in a pair may be shaped so that the heel of one shoe is not symmetrical or a mirror image of the heel of the other shoe and so that when the shoes are adjacent to one another, the configurations of the heels form a continuous shape or design.

Referring now back to FIGS. 1A-9B, the upper portion 4 of each shoe or article of footwear comprises a front portion 5 for enclosing, or partially enclosing a front portion of the user's foot and for retaining the user's foot adjacent the sole. In some embodiments, the upper portion 4 also includes a back portion 6 for enclosing or partially enclosing a user's heel and in further embodiments, the upper portion 4 includes a medial portion 7 (See, FIGS. 3A, 4B, 5A-5D, 6A-6D and 7B) which connects the front and back portions 5,6 of the upper portion 4. In addition, in the boot embodiments shown in FIGS. 3A-4B, the upper portion 4 encloses the user's entire foot and a portion of the user's leg.

The upper portion 4 of the shoe may be formed from any suitable material, including, but not limited to, leather, vinyl, canvas, fiber, rope, net, plastic, suede, PVC mesh, polyester, silicone, vulcanized rubber, nubuck, wool, PU, lace, silk, satin, flannel, fabric, fur, denim, towel, carpet, knitted, sequence, Lycra® or any other suitable material. The first and second shoes 1, 2 in the pair of shoes are made from the same or similar materials and may use a similar color scheme or a color scheme that continues from one shoe to another. However, in some embodiments, the materials between the first and second shoes in the pair may be varied depending on the configuration of the shoe. In certain embodiments, the upper portion 4 of the shoe includes one or more of the following: one or more straps, one or more zippers, one or more laces, one or more buckles, one or more hooks, one or more VELCRO® elements, one or more buttons, one or more elastics, one or more snaps, one or more loops, one or more holes, and one or more knots and/or ties.

As shown in FIGS. 1A-7C, the upper portion 4*a* of the first shoe 1 in a pair of shoes is not symmetrical with respect to the upper portion 4*b* of the second shoe 2 in the pair of shoes, and the upper portions 4*a*, 4*b* of the first and second shoes 1, 2 are not minor images of one another. In addition, as shown in FIGS. 1A-7C, the upper portions 4*a*, 4*b* of the first and second shoes are configured so that, when the first and second shoes are worn by the user and/or are adjacent to one another, the physical configuration of the upper portion 4*a* of the first shoe 1 and the physical configuration of the upper portion 4*b* of the second shoe 2 create a continuous visual effect so as to form a singular and unified theme or design. In this way, the asymmetrical configurations of the first and second shoes complement one another so that the unified design or theme of the pair is completed by placing the first shoe adjacent to the second shoe of the same pair. In FIGS. 8A-9B, the sole 3*a* the first shoe 1 in a pair of shoes is not symmetrical with respect to the sole 3*b* of the second shoe 2 in the pair of shoes, and the soles 3*a*, 3*b* of the first and second shoes 1, 2 are not minor images of one another. In addition, as shown in FIGS. 8A-9B, the soles 3*a*, 3*b* of the first and second shoes are configured so that, when the first and second shoes are worn by the user and/or are adjacent to one another, the configuration of the sole 3*a* of the first shoe 1 and the configuration of the sole 3*b* of the second shoe 2 create a continuous visual effect so as to form a singular and unified theme or design. In this way, the asymmetrical configurations of the first and second shoes complement one another so that the unified design or theme of the pair is completed by placing the first shoe adjacent to the second shoe of the same pair.

As shown in FIGS. 1A-7C, such asymmetrical configurations and continuous visual effect created by the asymmetrical configurations of the first and second shoes is achieved using a variety of techniques, including but not limited to, defining the shape of the periphery of the upper portions 4*a*, 4*b* of the first and second shoes 1,2, use and positioning of design and functional elements of the first and second shoes 1,2, such as straps or fastening members, use and positioning of stitching, contrasting portions and decorative pieces of the upper portions 4*a*, 4*b* of the first and second shoes. Fastening members include, but are not limited to, one or more zippers, a lacing system, one or more laces, one or more buckles, one or more straps with buckles, one or more hooks, one or more VELCRO® elements, one or more buttons, one or more elastics, one or more snaps, one or more loops, one or more holes, one or more knots and/or ties, or any other fastening elements. Decorative pieces include, but are not limited to, studs, feathers, sequence, beads, crystals, leather, ornaments, stitching, applications, pearls, bows, suede, fabric, textile and other pieces or materials.

In the embodiments shown in FIGS. 8A-9B, the asymmetrical configurations and continuous visual effect created by the asymmetrical configurations of the first and second shoes is also achieved using a variety of techniques, including but not limited to, defining the shape of the periphery of the soles 3*a*, 3*b* of the first and second shoes 1,2, defining the shape of the heels of the soles 3*a*, 3*b* of the first and second shoes, use and positioning of design elements on the heels or other portions of the soles 3*a*, 3*b*, and the like. In some embodiments, further continuity and asymmetricity can be provided by the use of color and/or application of a pattern or a motif to the first and second shoes so as to create a unified design that continues from one shoe to the other when the shoes are adjacent to one another. In some embodiments, a motif or pattern that creates continuity and asymmetricity in some embodiments can include one or more logos asymmetrically to the first and second shoes so that, when the shoes are adjacent to one another, the logo continues from one shoe to the other. In other embodiments, a motif or pattern may include lettering, including words, phrases and/or designs that include words or phrases, applied asymmetrically so that the lettering continues from one shoe to the other when the shoes are adjacent to one another. Moreover, the use of color to create continuity and asymmetricity may include use of gradients in color so that a color gradient is applied to the first and second shoes in an asymmetrical manner and so that the color gradient continues from one shoe to the other.

Figure 1A:
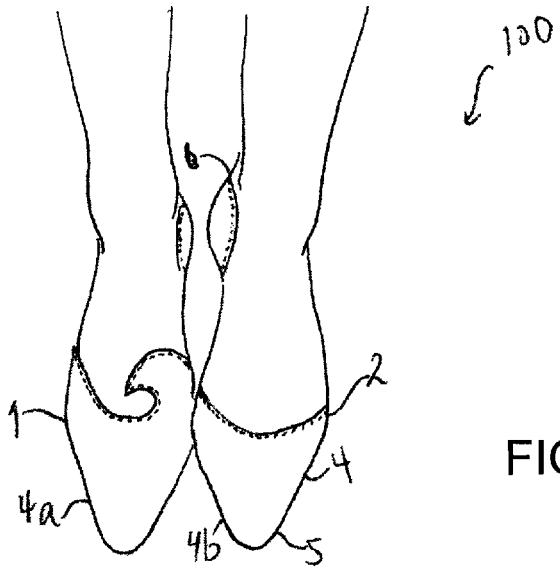
FIGS. 1A-1F show illustrative embodiments of women's asymmetrical footwear assemblies of the present invention, including women's shoes and sandals.

As mentioned above, FIGS. 1A-1G show illustrative embodiments of the asymmetrical footwear assemblies 100 which demonstrate the various techniques of achieving the asymmetrical configuration of the shoes in a pair of women's shoes, so that the asymmetrical configuration continues from one shoe to the other forming a singular unified design or theme. FIG. 1A shows an asymmetrical footwear assembly 100 which comprises a pair of women's shoes to be worn together by a user, and includes the first shoe 1 worn on a user's right foot and the second shoe 2 worn on a user's left foot. As shown in FIG. 1A, the first and second shoes 1, 2, include the upper portion 4*a*, 4*b*, respectively, each of which includes the front portion 5 enclosing, or partially enclosing, the front of the user's foot and the back portion 6 enclosing, or partially enclosing, the user's heel.

The front portions 5 of the first and second upper portions 4*a*, 4*b* in FIG. 1A are asymmetrical and are not minor images of one another, and the configurations of the front portions 5 of the first and second upper portions 4*a*, 4*b* create a continuous visual effect between the two shoes so as to form a unified design or theme when the shoes are adjacent to one another. In the embodiment shown in FIG. 1A, outer peripheries of the front portions 5 of the first and second shoes, which abut the top of the user's foot when worn, are shaped so as to create a wave-like shape or design. In FIG. 1A, the outer periphery, or edge, of the front portion 5 of the first upper portion 4*a* is shaped so as to include a trough and a curled crest of the wave-like shape. The outer periphery, or edge, of the front portion 5 of the second upper portion 4*a* is shaped so as to include another trough of the wave-like shape which is continues to the curled crest of the first upper portion 4*a*. When the first and second shoes 1, 2 of the assembly 100 are placed next to each other, the outer peripheries of the front portions 5 of the first and second upper portions 4*a*, 4*b* are aligned so that a continuous and unified wave-like shape is formed by the two upper portions 4*a*, 4*b*. This feature is further accentuated when the first and second shoes are worn by the user and the user's feet are placed next to one another, as shown in FIG. 1A.

Figure 1B:
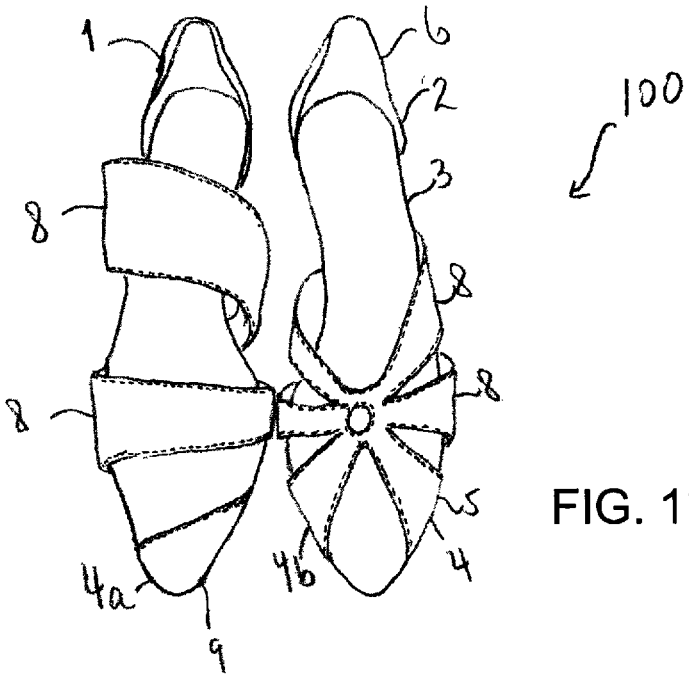

FIG. 1B shows another embodiment of the asymmetrical footwear assembly 100 in which the asymmetrical configuration and continuity between two shoes in a pair is achieved through the use of straps and/or spaces formed between the straps. As shown, the assembly 100 includes a pair of women's shoes including the first and second shoes 1, 2 adapted to be worn on a user's right foot and left foot, respectively. As in FIG. 1A, the first shoe 1 includes the upper portion 4*a* and the second shoe 2 includes the upper portion 4*b*, each of the upper portions 4*a*,4*b* including the front portion 5 that partially encloses the front of the user's foot and the back portion 6 that encloses, or partially encloses, the user's heel. As in FIG. 1A, the front portions 5 of the first and second upper portions 4*a*, 4*b* in FIG. 1B are asymmetrical with respect to one another and have configurations which create a continuous visual effect between the two shoes, and in particular, between the upper portions 4*a*, 4*b* of the shoes, so as to form a unified design, when the shoes 1, 2 are placed next to one another.

As shown in FIG. 1B, the upper portions 4*a* and 4*b* include a plurality of straps or strap-like members which are arranged so as to create a visual effect of a plurality of rays or ray-like members converging around a circular or ring-like opening. The front portion 5 of the second upper portion 4*b* includes the circular or ring-like opening, and a plurality of straps 8 that form the plurality of ray-like members converging into and around the circular opening. The front portion 5 of the first upper portion 4*a* includes two strap members 8 and front tip member 9 which are arranged so that, when the first and second shoes 1, 2 are adjacent to one another, the two strap members 8 and the front tip member 9 of the first upper portion 4*a* appear to continue from the respective adjacent ray-like members of the second upper portion 4*b*. That is, the positioning of the two strap members 8 and the front tip member 9 and their respective shapes are configured so that when the first and second shoes are adjacent to one another, a continuous visual effect is created of three ray-like members of the second upper portion 4*b* extending into the two strap members 8 and front tip member 9 of the first upper portion 4*a*.

Figure 1C:
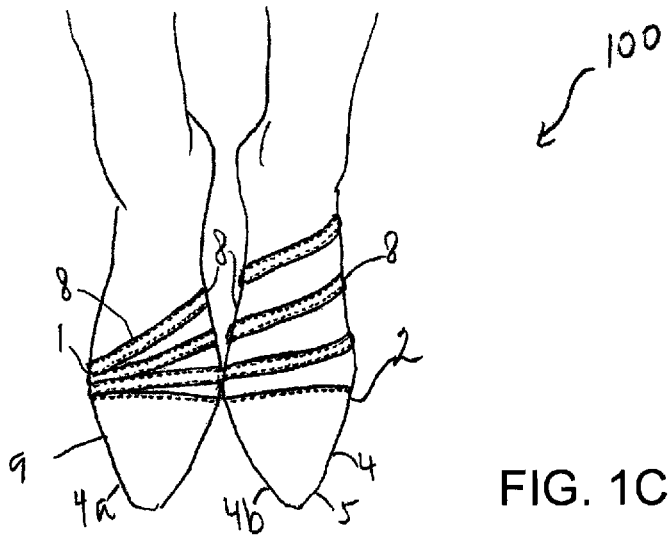

FIG. 1C shows another embodiment of the asymmetrical footwear assembly 100 in which the asymmetrical configuration and continuity between two shoes in a pair is achieved through the use and positioning of straps. As in the previously described embodiments, the assembly 100 includes a pair of women's shoes including first and second shoes 1, 2 adapted to be worn on the user's right and left feet, respectively. Each of the first and second shoes 1, 2 includes the upper portion 4*a*, 4*b*, respectively, and each upper portion 4*a*, 4*b*, includes the front portion 5. In this embodiment, the upper portions 4*a*, 4*b* do not include the back portion, but it is understood that the configuration of the shoes may be varied within the scope of the invention so as to add the back portion.

As shown in FIG. 1C, the upper portion 4*a*, 4*b* of each shoe 1,2 includes a front tip portion 9, and in this embodiment, the front tip portion 9 of the first shoe 1 is substantially symmetrical with the front tip portion 9 of the second shoe 2. As also shown, the upper portion 4*a*, 4*b* of each shoe 1, 2 includes three straps 8, which are arranged with respect to the sole and the front tip portion 9 so that the first upper portion 4*a* is asymmetrical with respect to, and is not a mirror image of, the second upper portion 4*b*. In particular, each of the three straps 8 of the first upper portion 4*a* extend at a different angle with respect to the front tip portion 9 so that the spaces between the straps increase from the left side to the right side of the shoe 1. The three straps 8 of the second shoe 2 are arranged with greater spacing therebetween than the straps of the first shoe 1, and are positioned and angled in such a way as to create a visual effect of continuity between the straps of the first shoe 1 and the straps of the second shoe 2 when the shoes are placed next to one another. In this way, a continuous unified design is formed by placing the first shoe 1 adjacent to the second shoe 2, or by placing the user's feet next to one another when the shoes are worn.

Figure 1D:
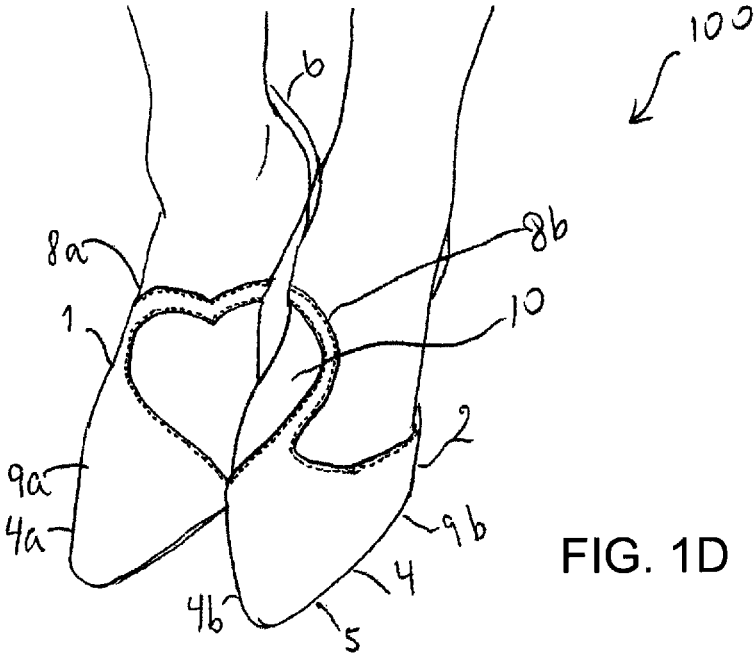

FIG. 1D shows another embodiment of the asymmetrical footwear assembly 100 in which the asymmetrical configuration and continuity between two shoes in a pair is achieved by defining the outer periphery of the upper portions 4*a*, 4*b* of the shoes and by using straps in an asymmetrical fashion. As shown in FIG. 1D, the first and second shoes 1, 2 of the footwear assembly 100, when worn by the user or when placed adjacent to one another, form a unified design that includes a heart-shaped opening 10. The first shoe 1 includes the first upper portion 4*a* which includes a front tip portion 9*a* and a strap 8*a* extending from a right side of the front tip portion 9*a* across a user's foot. The tip portion 9*a* and the strap 8*a* of the first shoe are shaped so as to form a portion of the heart-shaped opening 10. The second shoe 2 comprises the second upper portion 4*b* that includes a front tip portion 9*b* and a curved strap 8*b* extending from a top or outer periphery of the tip portion 9*b* and partially across a user's foot and thereafter connecting to the sole of the shoe 2. The front tip portion 9*b* and the curved strap 8*b* of the second shoe are shaped so as to form the remaining portion of the heart-shaped opening 10. In this way, when the first and second shoes are worn by the user and/or are placed adjacent to one another, the upper portions 4*a* and 4*b* of the first and second shoes 1, 2 are aligned so as to create a visual effect of the heart-shaped opening 10 which is continuous between the two shoes.

Figure 1E:
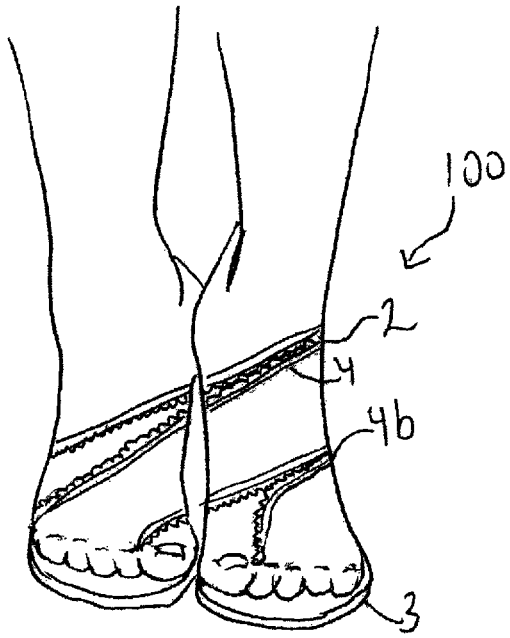
Figure 1F:
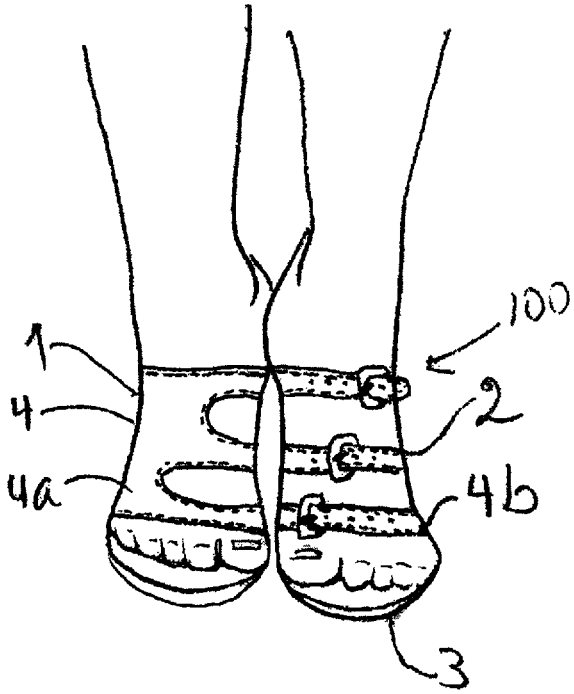

FIGS. 1E and 1F show additional illustrative embodiments of women's footwear assemblies which use straps and zippers or buckles to create the asymmetrical configuration of the shoes in a pair, in which the configurations of the two shoes create a continuous visual effect forming a unified design. In FIG. 1E, the footwear assembly 100 includes a pair of women's shoes, in which the upper portion 4*a* of the first shoe 1 and the upper portion 4*b* of the second shoe 2 are formed as straps that include zippers creating the asymmetrical configuration of the shoes 1,2 as well as the continuous theme or design from the first shoe 1 to the second shoe 2. In particular, the upper portion 4*a* of the first shoe 1 includes an opened or a partially opened zipper, or zipper-like strap member, extending across or around a front portion of a user's foot, wherein the zipper's half portions extend across or around the user's foot at different angles so as to create an appearance of the two halves approaching one another from one side of the shoe to the other. The upper portion 4*a* of the first shoe also includes a side strap comprising a half zipper portion adapted to extend around a user's big toe. The upper portion 4*b* of the second shoe 2 includes a partially opened zipper, or zipper-like strap member, extending across or around a user's foot or ankle, wherein the zipper's half portions extend at different angles and are arranged so that, when the first and second shoes 1, 2 are adjacent to one another, a visual appearance of continuity is created between the zipper halves of the first upper portion 4*a* and the zipper halves of the second upper portion 4*b*. In addition, the upper portion 4*b* of the second shoe 2 includes another partially opened zipper, or zipper-like strap member, with a closed portion of the zipper extending around a left side of the user's foot or ankle toward the front of the user's foot and with one half of an opened zipper portion extending to the front of the user's foot and the other half of the opened zipper portion extending around a right side of the user's foot. The other half of the opened zipper portion of the second upper portion 4*b* is configured and positioned so as to create a visual effect of being continuous with the side strap of the first upper portion 4*a* when the first and second shoes are adjacent to one another.

In FIG. 1F, the continuous visual effect is created by using a plurality of straps and buckles. In particular, the upper portion 4*a* of the first shoe 1 includes two large openings formed therein, which divide a solid piece of material extending around a right side of the user's foot into three strap-like members extending around top and left sides of the user's foot. The upper portion 4*b* of the second shoe 2 comprises three strap-like members, each of which extends across the user's foot and each of which includes a buckle. The strap-like members of the second upper portion 4*b* and the strap-like members of the first upper portion 4*a* are arranged and positioned so that when the shoes are placed next to each other, a visual effect is created of the strap-like members of the first upper portion 4*a* continuing into the strap-like members of the second upper portion 4*b*.

As discussed above, the asymmetrical footwear assembly of the present invention may be embodied as sandal style of footwear. FIGS. 2A-2D show four illustrative embodiments of asymmetrical sandal assemblies 200. As shown in FIGS. 2A-2D, each asymmetrical sandal assembly includes a pair of sandals 1,2, each sandal having a sole 3 and an upper portion 4*a*, 4*b*. In the embodiments shown, the sole 3 of each sandal is formed as a substantially flat member adapted for supporting a user's foot, but the configuration of the sole may be varied so as to include a heel or other elements. The upper portions 4*a*, 4*b* of the first and second shoes 1, 2, respectively, include one or more straps, or strap-like members, which are arranged and configured so that, when the first and second shoes 1, 2 are adjacent to one another, the straps of the first upper portion 4*a* and the strap of the second upper portion 4*b* create a visual effect of being continuous with one another, forming a unified theme or design. As is evident from FIGS. 2A-2D, the arrangement of the straps of the first and second upper portions 4*a*, 4*b* can have many variations so as to create many different configurations that form a unified continuous design from the first shoe 1 to the second shoe 2.

Figures 2A, 2B, 2C, 2D:
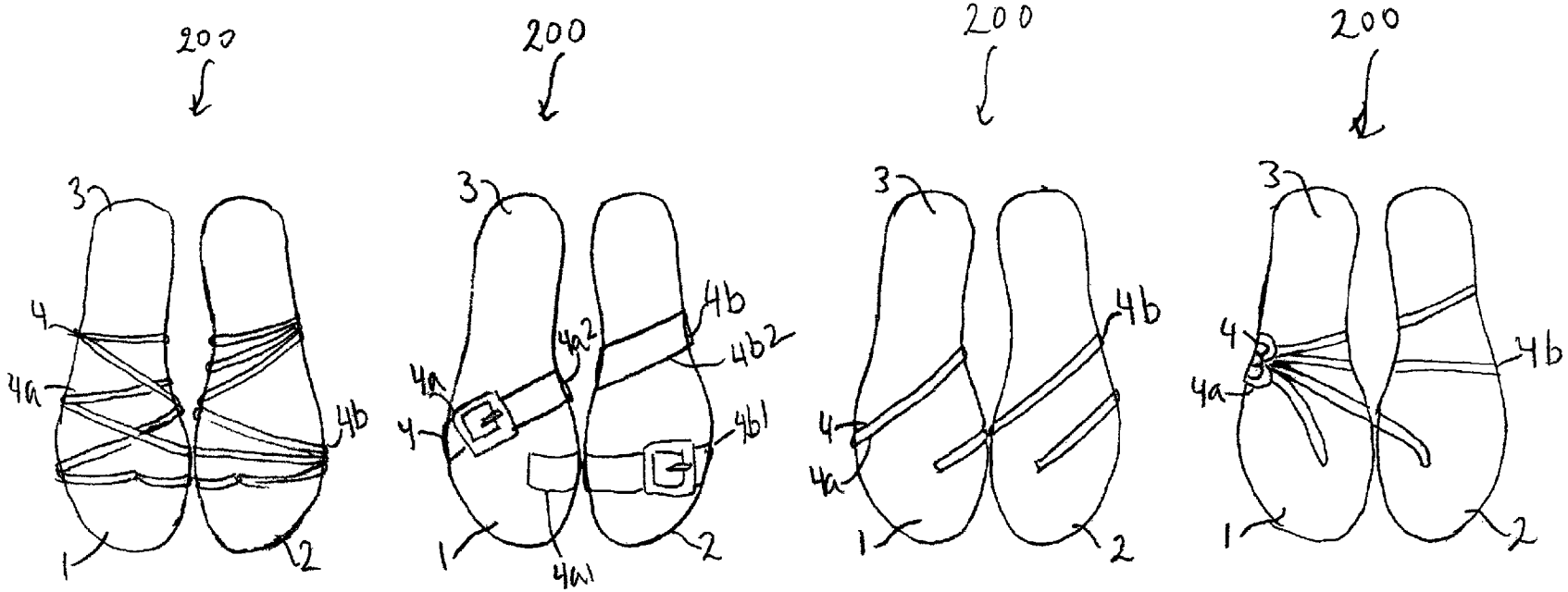
FIGS. 2A-2D show illustrative embodiments of women's asymmetrical sandal assemblies of the present invention.

In addition, buckles, or other elements, may be included in the upper portions 4*a*, 4*b* which create a visual effect of one or more straps extending from one shoe to the other shoe, where it is buckled. As shown in FIG. 2B, the upper portion 4*a* of the first shoe includes two strap-like members, with a first strap-like member 4*a*1 being adapted to extend around a user's big toe and a second strap-like member 4*a*2 being adapted to extend across a user's foot and including a first buckle. The upper portion 4*b* of the second shoe 2 also includes two strap-like members, with a first strap-like member 4*b*1 being adapted to extend around the front portion of the user's foot and including a buckle, and a second strap-like member 4*b*2 being adapted to extend across a middle portion of the user's foot. The first strap-like member 4*a*1 of the upper portion 4*a* and the first strap-like member 4*b*1 of the upper portion 4*b* are positioned so that when the first and second shoes 1, 2 are adjacent to one another, a visual effect is created of the first strap-like member 4*a*1 continuing to the first strap-like member 4*b*1 where the strap is buckled. Similarly, the second strap-like member 4*a*2 of the upper portion 4*a* and the second strap-like member 4*b*2 of the upper portion 4*b* are positioned so that when the first and second shoes are adjacent to one another, a visual effect is created of the second strap-like member 4*b*2 being continuous with the second strap-like member 4*a*2 where the strap is buckled.

Figure 3A:
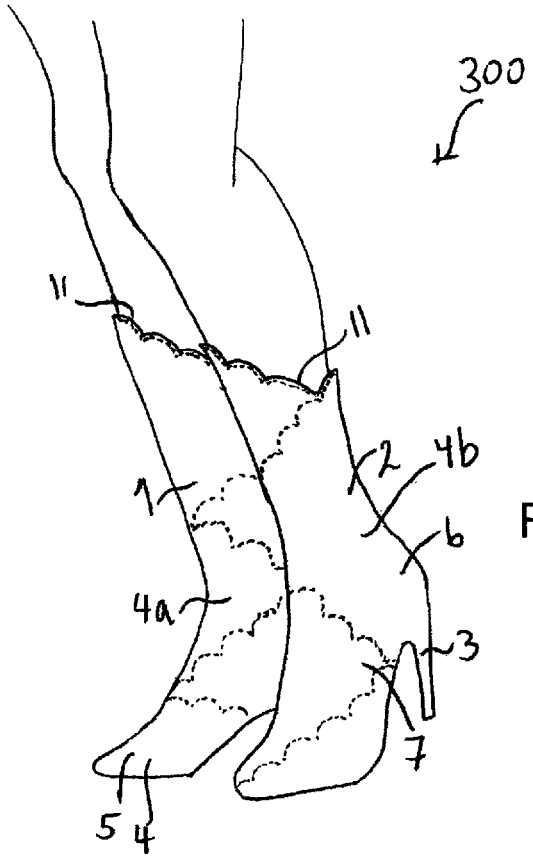
FIGS. 3A and 3B show perspective and front views of illustrative embodiments of women's asymmetrical boot assembly of the present invention.
Figure 3B:
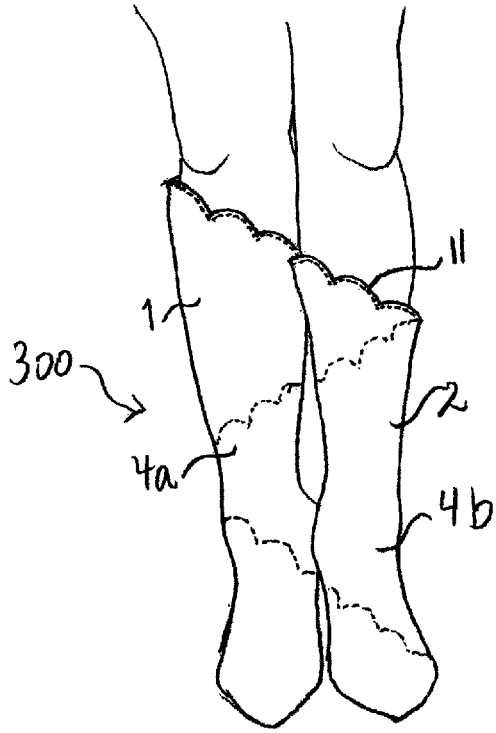

As discussed above, the asymmetrical footwear assembly may also be embodied in boot styles of footwear, as shown in FIGS. 3A-3B and FIGS. 4A-4B. FIGS. 3A and 3B show peripheral and front views of one illustrative embodiment of asymmetrical boot assembly 100. As shown in FIGS. 3A and 3B, the asymmetrical boot assembly 300 includes a first boot 1 and a second boot 2 which are worn by a user on the right and left feet, respectively. As shown, each boot 1, 2 includes a sole 3 with a heel adapted to support the user's foot and an upper portion 4*a*, 4*b* enclosing the user's foot, ankle and a portion of the user's lower leg. The upper portion 4*a* of the first boot 1 is asymmetrical with respect to the upper portion 4*b* of the second boot 2, and the configurations of the upper portions 4*a*, 4*b* create a visual effect of being continuous so as to create a unified design when the boots 1, 2 are adjacent to one another.

As shown in FIGS. 3A and 3B, each upper portion 4*a*, 4*b* has an outer upper periphery 11 which defines the top edge of the boot 1, 2, respectively. The asymmetrical and continuous configurations of the first and second boots 1, 2 are created by the respective outer upper peripheries 11 of the first upper portion 4*a* and the second upper portion 4*b*. As shown, the upper peripheries 11 of the first upper portion 4*a* and of the second upper portion 4*b* each have a scalloped edge which is angled with respect to the user's leg. The heights of the first upper portion 4*a* and of the second upper portion 4*b* are configured so that the upper-most edge of the upper periphery of the second upper portion 4*b* begins at about the same height as the lower-most edge of the upper periphery of the first upper portion 4*a*. In this way, when the first and second boots are adjacent to one another, the configurations of the first and second upper portions 4*a*, 4*b* create a visual effect of the upper peripheries of the first and second upper portions 4*a*, 4*b* being continuous from one boot to the other so as to create a unified design. In some embodiments, the first and upper portions 4*a* and 4*b* may also include stitching, such as decorative scalloped stitching arranged so as to create a visual effect of the stitching design continuing from one boot to the other.

Figures 4A, 4B:
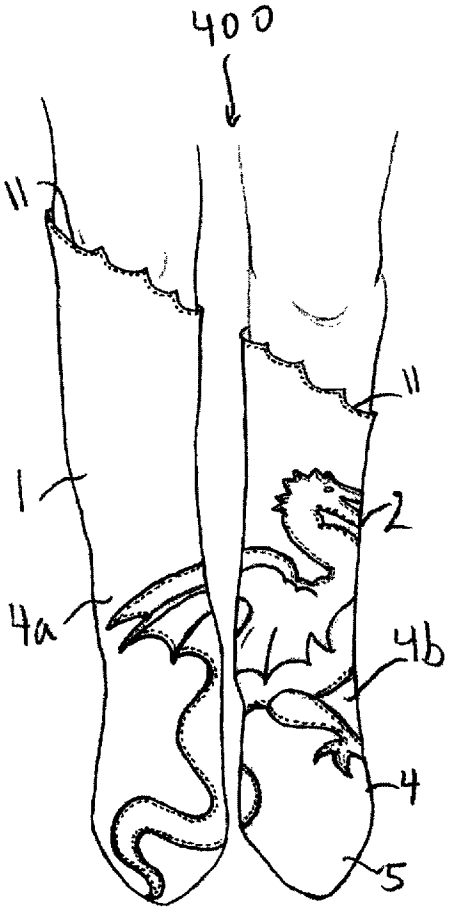
FIGS. 4A and 4B show front and back views of illustrative embodiments of women's asymmetrical boot assembly with a dragon motif applied to the boots.

FIGS. 4A and 4B show another illustrative embodiment of an asymmetrical boot assembly 400 of the present invention. FIG. 4A shows a front view of the asymmetrical boot assembly and FIG. 4B shows a back view thereof. The asymmetrical boot assembly 400 includes a pair of boots adapted to be worn by a user on the user's right and left feet, wherein the configuration of the first boot 1 is asymmetrical with respect to, and is not a minor image of, the configuration of the second boot 2. The configurations of the first and second boots 1, 2 also create a visual effect of continuity of design from one boot to the other when the boots are placed adjacent to one another. The asymmetrical and continuous configuration in this embodiment is created by the shapes of the upper portions 4*a*, 4*b* of the first and second boots 1, 2, as well as by a motif or a print placed on each of the upper portions 4*a*, 4*b* of the boots.

As shown in FIGS. 4A and 4B, the upper portion 4*a*, 4*b* of each boot 1, 2 has an outer upper periphery 11 defining the top edge of the boot 1, 2, respectively. The upper peripheries 11 of the first upper portion 4*a* and of the second upper portions 4*b* each have an edge with scalloped cut-outs, with the overall edge being angled with respect to the user's leg. As in the embodiment of FIGS. 3A and 3B, the heights of the first upper portion 4*a* and of the second upper portion 4*b* are configured so that the first upper portion 4*a* has a greater height than the second upper portion 4*b* and so that the upper-most edge of the upper periphery 11 of the second upper portion 4*b* starts at about the same height as the lower-most edge of the upper periphery 11 of the first upper portion 4*a*. Such configuration of the upper portions 4*a*, 4*b* creates a visual effect of the upper peripheries 11 of the first and second upper portions 4*a*, 4*b* being continuous from one boot to the other, forming a unified design.

In addition, the first and second boots of the asymmetrical boot assembly 400 of FIGS. 4A and 4B include a print or a motif applied to the upper portion 4*a*, 4*b* of each boot in an asymmetrical manner while also creating continuity between the first and second boots. As shown, the first boot 1 includes a motif of a dragon applied to the upper portion 4*a* of the boot so that the dragon motif extends from the back 6 of the upper portion, which shows the head and body of the dragon, around the medial portion 7 of the upper portion 4*a* and to the front 5 of the upper portion, which shows the tail end of the dragon. The second boot 2 includes the same motif of a dragon applied to its upper portion 4*b* so that the dragon extends in an opposite direction, from the front of the upper portion 4*b*, which shows the head and body of the dragon, around the medial portion 7 of the upper portion 4*b* and to the back 6 of the upper portion 4*b*, which shows the tail end of the dragon. When the first and second boots 1, 2 are placed adjacent to one another, a visual effect of the dragon motif continuing from one boot to the other is created, when the boot pair is viewed from the front and when the boot pair is viewed from the back.

As discussed above, the asymmetrical footwear of the present embodiment can also be embodied in athletic footwear and in men's footwear. FIGS. 5A-5C show illustrative embodiments of asymmetrical athletic footwear assemblies 500 and FIGS. 6A-6D show several illustrative embodiments of asymmetrical men's footwear assemblies 600. As shown in FIGS. 5A-5C, the asymmetrical athletic footwear assembly 500 includes a pair of athletic shoes, such as sneakers, in which the upper portion 4*a* of the first shoe 1 is asymmetrical with respect to the upper portion 4*b* of the second shoe 2, and the configurations of the upper portions 4*a* and 4*b* create a visual effect of continuity between the first and second shoes. In the illustrative embodiment of FIG. 5C, the asymmetrical configuration of the first and second shoes 1,2, and the continuity between the first and second shoe configurations, is created through the use and positioning of lacing in the upper portions 4*a*, 4*b* of the shoes 1, 2. In particular, the upper portion 4*a* of the first shoe 1 includes a lacing system 4*a*1 which is angled with respect to the user's foot so that the lacing extends from a top edge of the upper portion 4*a* toward a left side of the upper portion 4*a*. The upper portion 4*b* of the second shoe includes a decorative lacing system 4*b*1 which extends at angle from a right side of the upper portion 4*b* toward the top of the upper portion 4*b* and is arranged so as to create a visual effect of the lacing system 4*b*1 of the second shoe 2 being continuous with the lacing system 4*a*1 of the first shoe 1. The upper portion 4*b* of the second shoe 2 also includes a second lacing system 4*b*2 which extends from a top edge of the upper portion 4*b* toward a left side of the upper portion at the same angle as the decorative lacing system 4*b*1. In this way, the lacing systems 4*a*1, 4*b*1 and 4*b*2 of the first and second shoes create a visual effect of an angled lancing design that continues from one shoe to the other.

In the embodiments shown in FIGS. 5A-5B, the physical configurations, i.e. shape and other physical elements, of the first and second shoes 1, 2 are substantially symmetrical. However, the upper portions 4*a* and 4*b* include motifs or designs applied thereto which are asymmetrical and are not mirror images of one another. In particular, the first upper portion 4*a* of each assembly in FIGS. 5A-5B includes a first portion of the motif, while the second upper portion 4*b* of each assembly includes a second portion of the motif, which are applied to the first and second upper portions 4*a*, 4*b* so that when the first and second shoes are adjacent to one another, a visual effect of a complete and continuous motif is created. As shown in FIGS. 5A-5B, the motif applied to the first and second upper portions 4*a*, 4*b* can be any kind of design, and although not shown, can be a logo or lettering.

FIGS. 6A-6D show illustrative embodiments of asymmetrical men's footwear assemblies 600, each of the assemblies 600 including a pair of men's shoes to be worn together on a user's right and left feet. As shown, the asymmetrical footwear assemblies can be used for many different styles of men's shoes, including lace-up dress shoes shown in FIGS. 6A and 6C, zip-up dress shoes shown in FIG. 6B, slip-on dress shoes shown in FIG. 6D and a variety of other dress or casual styles. As discussed above, the first and second shoes 1, 2 in each pair are asymmetrical and are not minor images of one another, and the configurations of the first and second shoes 1, 2 form a visual effect of being continuous with one another when the first and second shoes are placed next to one another.

The asymmetrical and continuous configurations of the first and second shoes are formed using a variety of methods, some of which are shown in FIGS. 6A-6D. In FIG. 6A, the upper portions 4*a*, 4*b* of the first and second shoes 1, 2, respectively, are formed from contrasting portions which are arranged so that the shoes 1, 2 are asymmetrical and so as to create a continuous visual effect between the configurations of the first and second shoes. In particular, the upper portion 4*a* of the first shoe 1 includes a first contrasting portion 4*a*1 which extends from the back 7 of the upper portion 4*a* around the medial portion 7 and toward the front 5 and which forms a lacing system of the shoe 1. The upper portion 4*b* of the second shoe also includes a first contrasting portion 4*b*1 that extends from the back 7 toward the front 5 of the upper portion 4*b* and forms a lacing system of the shoe 2. The contrasting portion 4*b*1 of the second upper portion 4*b* extends further toward the front of the upper portion 4*b* than the contrasting portion 4*a*1 so that the lacing system of the second shoe 2 is greater in length than the lacing system of the first shoe 1. In addition, the shapes of the first contrasting portions 4*a*1 and 4*b*1 are configured and positioned so that, when the first and second shoes are next to one another, the contrasting portions 4*a*1, 4*b*1 create a visual effect of a singular continuing wave-like design extending from one shoe to the other. As also shown in FIG. 6A, the upper portions 4*a*, 4*b* of the first and second shoes each include a second contrasting portion 4*a*2, 4*b*2 extending at an angle and forming the front 5 of the upper portions 4*a*, 4*b*. The respective second contrasting portions 4*a*2, 4*b*2 have asymmetrical shapes, and are angled and positioned so that a visual effect of continuity therebetween is created when the first and second shoes are adjacent to one another.

The use of contrasting portions and asymmetrical configurations of the lacing systems is also shown in the embodiments of the footwear assemblies in FIGS. 6C and 6D. In particular, FIG. 6C shows a footwear assembly 600 in which the upper portions 4*a*, 4*b* are formed from several pieces of material, including a piece 4*a*1, 4*b*1 forming the back and medial portions 6, 7 of the upper portions 4*a*, 4*b* and a lacing system of each shoe. Each piece 4*a*1, 4*b*1 is configured so that the front edge of the piece 4*a*1, 4*b*1 is angled with respect of the user's foot, and the piece 4*a*1 extends further toward the front of the first upper portion 4*a* than the piece 4*b*1 of the second upper portion, so that the lacing system of the first upper portion 4*a* is greater in length than the lacing system of the second upper portion 4*b*. When the shoes 1, 2 of FIG. 6C are placed next to one another, a visual effect of continuity is created by the configurations of the pieces 4*a*1 and 4*b*1 of the upper portions 4*a*, 4*b*. The upper portions 4*a*, 4*b* of the first and second shoes 1,2 of the footwear assembly of FIG. 6D are also formed from a plurality of pieces, including a contrasting strap-like member. As shown in FIG. 6D, the plurality of pieces of the first upper portion 4*a* and of the second upper portion 4*b* are configured and arranged so as to create a visual effect of overlaying pieces extending across the first shoe 1 and on to the second shoe 2 and terminating at the second shoe 2, when the first and second shoes 1, 2 are adjacent to one another. In addition, the contrasting strap-like member in FIG. 6D extends across the first upper portion 4*a* and the corresponding strap-like member extends partially across and partially around the second upper portion 4*b* and terminates at a buckle.

Finally, the illustrative embodiment of the footwear assembly in FIG. 6B uses a plurality of zippers to form the asymmetrical upper portions 4*a*, 4*b* of the first and second shoes 1,2 and to create the continuous visual effect between the first and second shoes 1, 2. Specifically, the first upper portion 4*a* includes two angled zippers, while the second upper portion 4*b* includes one zipper which is arranged so that when the two shoes are adjacent to one another, a visual effect is created of the front-most zipper of the first upper portion 4*a* being continuous with the zipper of the second upper portion 4*b*.

As discussed above, the asymmetrical footwear assembly may also be embodied in children's shoes, illustrative embodiments of which are shown in FIGS. 7A-7C. In FIG. 7A, the asymmetrical children's footwear assembly 700 includes a pair of children's sandals 1, 2, each of which has an upper portion 4*a*, 4*b*, respectively, comprising a plurality of strap-like members. The strap-like members of the first upper portion 4*a* are asymmetrical with respect to the strap-like members. The first upper portion 4*a* includes a strap-like member that divides into two straps adapted to extend across the front of the user's foot and another strap-like member adapted to extend across the middle portion of the user's foot. The second upper portion 4*b* includes a single strap-like member adapted to extend across the front of the user's foot, and another strap-like member that divides into two straps adapted to extend across the middle portion of the user's foot. The strap-like members of the first upper portion 4*a* and of the second upper portion 4*b* are configured and positioned so that when the first and second shoes 1, 2 are adjacent to one another, a visual effect of continuity between the straps of the first and second upper portions 4*a*, 4*b* is created, as shown in FIG. 7A.

In addition to the visual effect of continuity being created by the arrangement of the straps of the first and second upper portion 4*a*, 4*b*, a further visual effect of continuity may be created by the application of a color gradient to the first and second upper portions 4*a*, 4*b* (not shown). For example, the color gradient applied to the first and second upper portions 4*a*, 4*b* may include two or more colors, extending from one color to another color beginning on the first upper portion 4*a* and ending on the second upper portion 4*b*. In this way, when the first and second shoes 1,2 are adjacent to one another, the color gradient between the first and upper portions 4*a*, 4*b* is continuous and completed by the first and second upper portions 4*a*, 4*b*. In other embodiments, the color gradient applied to the first and second upper portions 4*a*, 4*b* may include one color continuously varying from a lighter to darker shade of the color from the first upper portion 4*a* to the second upper portion 4*b*. In this way, when the first and second shoes 1, 2 are adjacent to one another, the color gradient applied to the first and second upper portions 4*a*, 4*b* creates a visual effect of continuity and is completed by the first and second upper portions 4*a*, 4*b*.

In FIG. 7B, the children's footwear assembly 700 includes a pair of children's shoes which have a substantially symmetrical shape. However, motifs or designs applied to the upper portions 4*a*, 4*b* of the first and second shoes 1, 2 of the assembly 700 are asymmetrical and are not mirror images of one another. In particular, the first shoe 1 includes a small flower motif and a portion of a large flower motif applied to the upper portion 4*a*, and the second shoe 2 includes a portion of a medium sized flower motif and a complementary portion of the large flower motif applied to the upper portion 4*b*. When the first and second shoes 1, 2 are adjacent to one another, a visual effect is created of a continuous motif between the upper portions 4*a*, 4*b* of the first and second shoes 1,2. Although this embodiment uses a flower motif applied to the first and second shoes of the assembly, it is understood that the motif or design may be varied. In addition, in other embodiments, a desired motif may be applied to the first and second shoes having asymmetrical shapes, similar to those described above with respect to FIGS. 1A-7A.

FIG. 7C shows another embodiment of the children's footwear assembly 700 that includes a pair of children's shoes which have a substantially symmetrical shape but include a motif applied to the upper portions 4*a*, 4*b* of the first and second shoes 1, 2 that are asymmetrical and are not mirror images of one another. In particular, the first shoe 1 includes a motif of a cat and a portion of a yarn extending from the cat's paw applied to the first upper portion 4*a*, while the second shoe 2 includes a motif of the remaining portion of the yarn ending with a ball of yarn applied to the second upper portion 4*b*. The motifs applied to the first and second upper portions 4*a*, 4*b* form a continuous idea or story therebetween, so that when the first and second shoes are adjacent to one another, a visual effect of continuity between the yarn portions applied to the first and second upper portions is created. In addition, even when the first and second shoes are not adjacent to one another, a continuous idea or story is created between the first and second shoes 1, 2, so that when the user wears the shoes, the movement of the user's feet closer and further away from one another while walking creates a visual effect of the cat chasing the ball of yarn. Although this embodiment uses a motif of a cat with a ball of yarn applied asymmetrically to the upper portions 4*a*, 4*b* of the first and second shoes, it is understood that the motif or design may be varied. In addition, in other embodiments, a desired motif may be applied to the first and second shoes having asymmetrical shapes, similar to those described above with respect to FIGS. 1A-7A.

As discussed above, in some embodiments, the soles of the first and second shoes 1, 2 of the footwear assembly are asymmetrical with respect to one another and have configurations which form a visual effect of continuity from the sole of the first shoe to the sole of the second shoes. Illustrative examples of such footwear assemblies are shown in FIGS. 8A-8D, which show a plurality of sandal footwear assemblies in which the sole of the first shoe is asymmetrical with respect to the sole of the second shoe, and in FIGS. 9A and 9B, which show footwear assemblies in which heels of the first and second shoes area asymmetrical with respect to one another.

FIG. 8A shows an illustrative embodiment of a flip-flop type footwear assembly 800 that includes a first sandal 1 having a first sole 3*a* and a first upper portion 4*a* and a second sandal 2 having a second sole 3*b* and a second upper portion 4*b*. The first and second soles 3*a*, 3*b* each have different physical configurations or shapes, so that the first sole 3*a* is not a minor image of the second sole 3*b*. The different shapes of the first sole 3*a* and the second sole 3*b* are created by the star-shaped motifs applied to the first and second soles 3*a*, 3*b* and the ends of the star-shaped motifs protruding slightly from the outer side periphery of each sole 3*a*, 3*b*. As shown, the first sole 3*a* includes a small star-shaped motif applied to the front portion of the sole which has two ends protruding slightly from the outer periphery of the sole 3*a* and a larger star-shaped motif applied to the back portion of the sole 3*a* having three ends protruding slightly from the outer periphery of the sole 3*a*. The first sole 3*a* also has a first portion of a large star motif applied thereto. As also shown, the second sole 3*b* includes a second portion of the large star motif applied thereto, with three of the ends of the star-shaped motif protruding from the outer side periphery of the sole 3*b*, and a smaller star-shaped motif applied to a back portion of the sole 3*b* with two of the ends of the star protruding slightly from the outer periphery of the sole 3*b*. When the first and second sandals 1, 2 are adjacent to one another, a visual effect of continuity between the first portion of the large star motif and the second portion of the large star motif applied to the first and second soles 3*a*, 3*b* is created. The upper portions 4*a*, 4*b* shown in FIG. 8A are substantially symmetrical, but in other embodiments may be made asymmetrical, such as in the embodiments shown in FIGS. 2A-2D.

FIGS. 8B-8D show further illustrative embodiments of flip-flop type footwear assemblies 800 in which the shapes of the soles are substantially symmetrical to one another, but the motifs applied to the soles 3*a*, 3*b* are asymmetrical with respect to one another and create an effect of continuity between the motifs applied to the soles 3*a*, 3*b* of the first and second shoes 1, 2 when they are adjacent to one another. In FIG. 8B, the motif applied to the soles 3*a*, 3*b* of the first and second shoes is the word "PEACE" in a decorative font, wherein a first portion of the motif, i.e. letters "A" and "E" and a portion of another letter "E," are applied to the first sole 3*a* and a second portion of the motif, i.e. letters "P" and "C" and a remaining portion of the other letter "E," are applied to the second sole 3*b*. The upper portions 4*a*, 4*b* shown in FIG. 8B are substantially symmetrical, but in other embodiments may be made asymmetrical, such as in the embodiments shown in FIGS. 2A-2D.

In FIG. 8C, the motif applied to the soles 3*a*, 3*b* of the first and second shoes 1, 2 is a motif of train tracks and the upper portions 4*a*, 4*b* create a visual impression of a bridge when viewed from above so that the train tracks in the motif appear to run under the bridge. In this way, the upper portions 4*a*, 4*b* and the soles 3*a*, 3*b* form a common concept between the first and second shoes. As shown in FIG. 8C, the motif of the train tracks is applied to the soles 3*a*, 3*b* asymmetrically, so that the first sole 3*a* has a first portion of the train tracks applied to a front portion thereof and the second sole 3*b* has a second portion of the train tracks applied to a rear portion thereof. Further, an additional motif of tree-tops is applied asymmetrically to the soles 3*a*, 3*b*, such that the second sole 3*b* includes a first portion of the tree-tops motif applied to a front portion thereof, forming the main portion of the tree-tops motif, and the first sole 3*a* includes a second portion of the tree-tops motif. When the first and second shoes 1, 2 are adjacent to one another, the train tracks motif creates a visual effect of continuing from one sole to the other, and the tree-tops motif creates a visual effect of continuing from one sole to the other.

In FIG. 8D, the motif applied to the soles 3*a*, 3*b* of the first and second shoes 1, 2 is a logo of a letter "M." In particular, a first portion of the logo is applied to the first sole 3*a* of the first shoe 1 and the remaining second portion of the logo is applied to the second sole 3*b* of the second shoe 3. The logo portions are applied to the first and second soles 3*a*, 3*b* asymmetrically, and when the first and second shoes 1, 2 are adjacent to one another, a visual effect of continuity is created between the first and second logo portions so that a complete and continuous logo motif is shown.

Figure 9A:
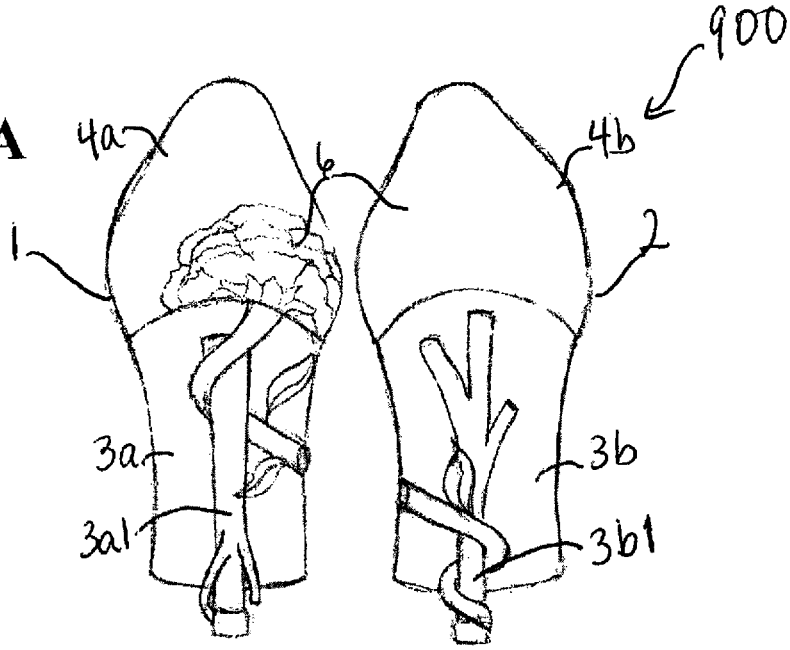
FIGS. 9A and 9B show back views of illustrative embodiments of footwear assemblies of the present invention.
Figure 9B:
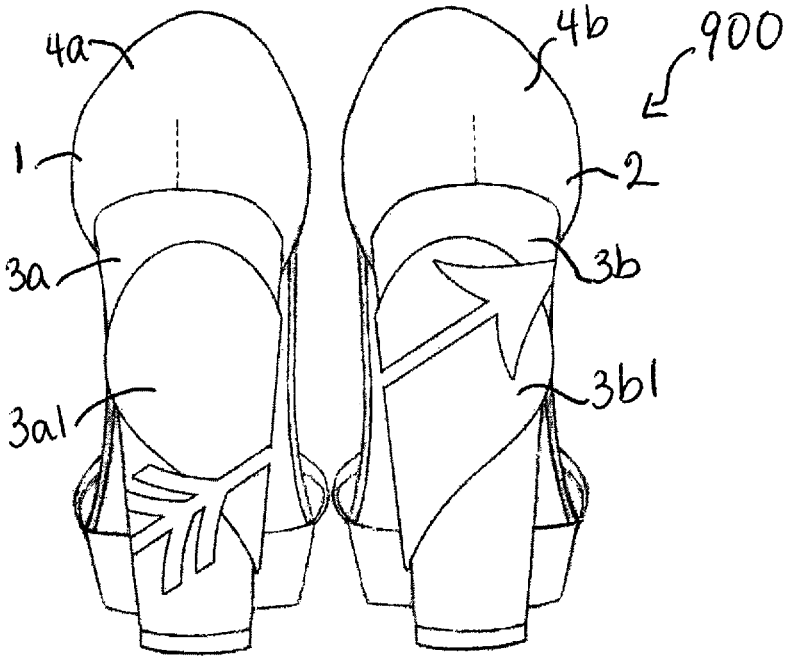

FIGS. 9A and 9B show other illustrative embodiments of footwear assemblies in which the soles, and in particular, the heels, of the first and second shoes are asymmetrical with respect to one another and create a visual effect of continuity between the first and second shoes when the shoes are adjacent to one another. In FIG. 9A shows a back view of a high-heeled footwear assembly 900 that includes a first shoe 1 having a first sole 3*a* with a heel 3*a*1 and a first upper portion 4*a* and a second shoe 2 having a second sole 3*b* with a second heel 3*b*1 and a second upper portion 4*a*. The physical configurations, or shape of the first and second heels 3*a*1, 3*b*1 are asymmetrical and are not minor images of one another, and when the first and second shoes are adjacent one another, the configurations 3*a*1, 3*b*1 of the heels create a visual effect of continuity between the two heel configurations forming a unified theme or design. As shown in FIG. 9A, the first heel 3*a*1 of the first shoe 1 includes a trunk portion forming the support of the heel 3*a*1 and an upper stem portion of a flower which extends around the trunk portion. As also shown, the first upper portion 4*a* of the first shoe 1 includes a flower top motif applied thereto which extends from and is continuous with the upper stem portion of the heel 3*a*1. The second heel 3*b*1 of the second shoe 2 also includes a trunk portion forming the support of the heel 3*b*1 and which has a different shape from the trunk portion of the first heel 3*a*1. The second heel 3*b*1 also has a lower stem portion of the flower which extends around the trunk portion of the second heel 3*b*1. The upper and lower stem portions of the first and second heel 3*a*1, 3*b*1 are shaped and positioned so that, when the first and second shoes 1, 2 are adjacent to one another, a visual effect is created of continuity between the upper and lower stem portions of the heels 3*a*1, 3*b*1 and a unified design of a flower with a stem winding around two trunks is formed by the first and second shoes 1, 2.

FIG. 9B shows another illustrative high-heeled footwear assembly 900 in which the heels of the first and second shoes are asymmetrical with respect to one another and when the first and second shoes are adjacent to one another, a visual effect of continuity between the heels of the two shoes is created. In FIG. 9B, the asymmetricity and continuity of the heels 3*a*1, 3*b*1 is created by carving a motif in the outer surfaces of the first and second heels 3*a*1, 3*b*1. The heels in this illustrative embodiment may be formed from a variety of materials, including wood, plastic, rubber, vulcanized rubber and the like. As shown, the heel 3*a*1 of the first shoe 1 has carved therein a first portion of the motif of a heart with an arrow, which includes a half of the heart and one end of the arrow. The heel 3*b*1 of the second shoe 2 has carved therein a second portion of the motif including the other half of the heart and the other end of the arrow, including the arrow point. The configurations of the heels 3*a*1 and 3*b*1 are asymmetrical with respect to one another, and when the first and second shoes are placed next to one another, a visual effect is created of continuity between the carvings in the first and second heels 3*a*1, 3*b*1 so that the heart and arrow motif is completed. As can be appreciated, the motif may be varied and the application of the motif is not limited to carving and may include other techniques, such as molding, stamping, etc.

The above described embodiments of asymmetrical footwear assemblies illustrate the numerous ways of applying the present invention. The asymmetrical configurations of the shoes in each pair enable designers to develop many new styles and designs, without requiring the shoes to be minor images of one another. In addition, the continuous configuration of the two shoes, whereby a visual effect of a unified design is created by placing the two shoes adjacent to one another, greatly expands the possibilities of new footwear designs. As also demonstrated by the illustrative embodiments of FIGS. 1A-9B, the asymmetrical footwear of the present invention can be used with all footwear categories, including men's, women's and children's footwear, and with all different styles of footwear, including, but not limited to, boots, shoes, sandals, pumps, clogs, mules, oxfords, loafers, slippers, wedges, platforms, espadrilles, booties, mary janes, t-straps, slides, thongs, flip flops, flats, slingbacks, ballerina shoes, specialty shoes such as wide shoes, narrow shoes, dance shoes, diabetic approved shoes, eco-friendly shoes, bridal shoes, vegetarian/vegan shoes, etc.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. An asymmetrical footwear assembly comprising:

a first article of footwear and a second article of footwear, said first and second articles of footwear being adapted to be worn on a user's right and left feet, respectively, said first article of footwear comprises a first sole and a first upper portion coupled to said first sole and said second article of footwear comprises a second sole and a second upper portion coupled to said second sole;

wherein said first upper portion of said first article of footwear includes a plurality of straps, including at least a first strap and a second strap separate and apart from the first strap, each of the plurality of straps extending from a medial side of the first sole toward an opposing lateral side of the first sole, and the second upper portion of the second article of footwear includes a plurality of straps, including at least a third strap and a fourth strap separate and apart from the third strap, each of the plurality of straps extending from a medial side of the second sole toward an opposing lateral side of the second sole, and wherein a first arrangement of the first and second straps is different from a second arrangement of the third and fourth straps so that a configuration of the first upper portion is asymmetrical with respect to a configuration of said second upper portion of said second article of footwear and so that said first and second articles of footwear are not mirror images of one another, and wherein, when said first and second articles of footwear are adjacent to one another, the first and second arrangements of the first, second, third and fourth straps create a visual effect of continuity between the first and second arrangements and form a predetermined design.

2. An asymmetrical footwear assembly in accordance with claim 1, wherein said first and second articles of footwear comprise first and second boots, wherein said first upper portion has a greater height than said second upper portion so that said first upper portion is asymmetrical with respect to said second upper portion, and wherein, when said first and second boots are adjacent to one another, said first and second upper portions create said visual effect of continuity between an upper edge of said first upper portion and an upper edge of said second upper portion.

3. An asymmetrical footwear assembly in accordance with claim 1, wherein the entire first upper is formed from the plurality of straps and the entire second upper is formed from the plurality of straps.

* * * * *